US005740516A

United States Patent [19]

Jiranek, II et al.

[11] Patent Number: 5,740,516

[45] Date of Patent: Apr. 14, 1998

[54] FIREARM BOLT

[75] Inventors: Marlin R. Jiranek, II; Michael D. Keeney, both of Elizabethtown, Ky.

[73] Assignee: Remington Arms Company, Inc., Madison, N.C.

[21] Appl. No.: 777,264

[22] Filed: Dec. 31, 1996

[51] Int. Cl.[6] ..... C22C 1/04; C22C 27/04; F41A 3/12; B22F 5/00

[52] U.S. Cl. ..... 428/553; 428/665; 428/457; 428/908.8; 75/248; 420/430; 420/432; 42/16; 42/17; 29/903; 29/DIG. 31; 419/38; 419/28; 419/29; 419/54; 419/55

[58] Field of Search ..... 75/248; 428/553, 428/665, 457, 908.8; 42/16, 17; 419/38, 28, 29, 54, 55; 420/430, 432; 29/903, DIG. 31

[56] References Cited

U.S. PATENT DOCUMENTS

| | | | |
|---|---|---|---|
| H1075 | 7/1992 | Kapoor | 420/430 |
| 2,736,117 | 2/1956 | Clarkson et al. | 42/75 |
| 3,056,226 | 10/1962 | Hubbard et al. | 42/69 |
| 3,885,293 | 5/1975 | Bateman, Jr. et al. | 29/416 |
| 4,015,357 | 4/1977 | Andersson | 42/16 |
| 4,090,875 | 5/1978 | Ludwig | 75/248 |
| 4,454,672 | 6/1984 | Timart | 42/16 |
| 4,593,488 | 6/1986 | Ruger | 42/75 C |
| 4,612,048 | 9/1986 | German et al. | 75/246 |
| 4,614,544 | 9/1986 | Lall | 75/246 |
| 4,990,195 | 2/1991 | Spencer et al. | 148/11.5 F |
| 5,294,269 | 3/1994 | Lee et al. | 148/514 |
| 5,306,364 | 4/1994 | Hong et al. | 148/673 |
| 5,421,119 | 6/1995 | Miner | 42/69.01 |

*Primary Examiner*—Daniel J. Jenkins
*Attorney, Agent, or Firm*—Huntley & Associates

[57] ABSTRACT

A firearm bolt prepared from an alloy of tungsten, nickel and iron having a density of about from 14.1 g/cc to 18.0 g/cc. The alloy preferably also contains at least one of molybdenum, cobalt, rhenium, tantalum and gold. The alloy is preferably manufactured by standard powder metallurgical techniques followed by a liquid phase sinter and vacuum anneal. The bolt can also be manufactured using solid state sintering. The bolt can also be manufactured by mechanically working the material after sintering, after annealing, or after both sintering and annealing.

16 Claims, 1 Drawing Sheet

FIREARM BOLT

BACKGROUND OF THE INVENTION

Firearm bolts in automatic and semiautomatic systems, wherein the operating energy is derived from blowback with the inertia of the bolt alone restraining the rearward movement of the cartridge, are typically made of a variety of steels which have a density of about 7.83 g/cc. In principle, the mass of the bolt is proportional to the energy of the cartridge to be fired in the firearm. For higher energy cartridges, past practice has been to increase the volume of the bolt to obtain the mass requirements. To obtain higher mass using the conventional steel alloys, a larger receiver volume is required. Obtaining these mass requirements while maintaining an aesthetically pleasing firearm is difficult.

To achieve a properly functioning firearm for higher energy cartridges while maintaining a conventional exterior geometry, the density of the bolt material can be increased. However, the other mechanical properties of the bolt, such as yield strength, hardness and ductility, must remain within acceptable ranges, and this combination of properties has not been previously attained.

SUMMARY OF THE INVENTION

The present invention provides a firearm bolt having excellent performance characteristics and a density in the range of about from 14.1 g/cc to 18.0 g/cc.

Specifically, the present invention provides a firearm bolt comprising, elementally, in parts by weight, about from 70 to 98% tungsten, and the balance comprising nickel and iron, wherein the ratio of nickel to iron is about from 1.5 to 5.

The present invention preferably further comprises up to about 20% of at least one additional metal selected from the group consisting of molybdenum, cobalt, rhenium, tantalum and gold.

The present invention also provides a process for manufacturing a firearm bolt, comprising the steps of:

admixing about from 70 to 98% tungsten, the balance comprising nickel and iron, wherein the ratio of nickel to iron is about from 1.5 to 5, to form a powder metal mixture;

pressing the powder metal mixture to form a green bolt blank compact;

sintering the green bolt blank compact to form a sintered bolt blank; and finishing the sintered bolt blank to form a finished firearm bolt.

BRIEF DESCRIPTION OF THE DRAWING

The FIGURE is a schematic cross-sectional illustration of one embodiment of the bolt of the present invention.

DETAILED DESCRIPTION OF THE INVENTION

Figure 1:
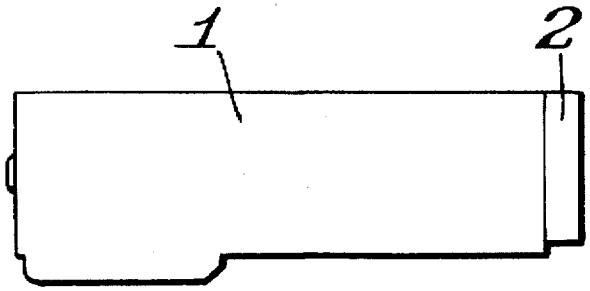

The present invention provides high density firearm bolts which exhibit the required mechanical characteristics such as yield strength, hardness and ductility. The bolts are prepared from tungsten alloys of compositions comprising (by weight percent) about from 70 to 98% tungsten (W), and the balance comprising nickel (Ni) and iron (Fe), wherein the ratio of nickel to iron is about from 1.5 to 5. Optionally and preferably, up to about 20% of at least one of molybdenum (Mo), cobalt (Co), rhenium (Re), tantalum (Ta) and gold (Au) can be added to the metal mixture. The additional metal components are added to precisely adjust the mechanical characteristics of the resulting alloy, and particularly the hardness, ductility, and yield strength desired for the finished firearm bolt. The specific amounts of the additional components used will vary with the concentrations of the basic components of tungsten, nickel and iron, and, within the parameters discussed above, the specific concentrations of the components will be evident to those skilled in the art. The density of the sintered alloy is about from 14.1 g/cc to about 18.0 g/cc.

The bolt of the present invention can be prepared by standard powder metallurgical processes. Other powder metallurgical processes known to those skilled in the art can be used to produce the bolt of the present invention.

A powder metal mixture is obtained by blending fine powders of the individual components of the alloy. The components are added in weight percentages selected from the ranges shown above. The fine powders of the individual components can be used directly as they are obtained through normal commercial channels. The powders typically have a particle size of about from 0.5 to 150 microns. These can be provided to the compositions of the present invention as either elemental or pre-alloyed powders. A binder, consisting of, for example, a low melting point paraffin wax, is generally added during this admixing step to aid in forming the green compact. In general, about from 0.5 to 2% of the binder is used, based on the total weight of the metal components. About 1% binder has been found to be particularly satisfactory for a wide variety of metal blends.

Once the powder metal mixture has been produced, it is pressed into a green compact approximating the desired shape and size of the finished bolt. Typically a pressure of about from 5 to 50 tons per square inch (tsi) is used, and preferably a pressure of about from 25 to 30 tsi. Pressures below about 5 tsi can result in undesirable shrinkage during sintering, and pressures above about 50 tsi are generally impractical due to limitations of the machinery and tooling. Pressing can be carried out at ambient or elevated temperatures.

The green compact is sintered. The sintering process can be either liquid phase sintering, in which the nickel and iron melt and the tungsten remains essentially solid; or solid state sintering, in which there is no melting of the metal components and the resulting sintered product is typically characterized by higher porosity. Liquid phase sintering is typically performed at a temperature about from 1,450° to 1,600° C. while solid state sintering is generally performed at a temperature about from 1,000° to 1,450° C. The exact sintering temperature will vary with the specific composition of the green compact.

Additionally, the unworked sintered firearm material can be vacuum annealed. Typically vacuum annealing is used. The vacuum anneal takes place at a temperature and for a period of time which varies based on the specific composition. The annealing temperature ranges are about from 800° to 1,200° C. for a period about from 2 to 7 hours.

Additionally, the sintered only or sintered and vacuum annealed firearm bolt can be mechanically worked to obtain the desired physical properties. This mechanical working is accomplished, for example, by forging, swaging or extruding processes, as are generally used in the metal working arts.

The compositions of the present invention exhibit the density, yield strength, hardness, and ductility required for use as bolts in firearms. Specifically, the density of present alloys is about from 14.1 g/cc to 18.0 g/cc and exhibit a minimum Rockwell "C" scale hardness of 33, minimum yield strength of about 120,000 psi, and a minimum elongation to failure of about 10%.

In another, preferred, embodiment of the present invention, the firearm bolt has a steel, ceramic or plastic face on the forward, or barrel, end of the bolt. This steel, ceramic or plastic face resists the impact forces generated when the bolt strikes the barrel during the portion of the firing cycle when the bolt is moving forward. FIG. 1 shows this embodiment where bolt 1 is provided with face 2. Face 2 can be mechanically attached to bolt 1, for example, by drilling and tapping a hole in bolt 1 and providing face 2 with a mating threaded section. Other means of attachment include using adhesives, and brazing or soldering face 2 onto bolt 1.

The present invention is further illustrated by the following specific examples, in which parts and percentages are by weight unless otherwise specified.

EXAMPLE 1

A powder metal mixture is obtained by tumble blending 85% W, 8% Mo, 5.1% Ni, 1.4% Fe and 0.5% Co, each in powder form. 1%, based on the total weight of the metal components, of a low melting point paraffin wax is added to the powder metal mixture. The mixture is pressed under 25–30 tsi to form a green bolt blank compact. The green bolt blank compact is sintered at about 1,480° C. and vacuum annealed at 1,100° C. for about 4 hours. The sintered and annealed bolt blank is then machined to the final desired bolt geometry with a density of about 16.67 g/cc, a yield strength of about 120,000 psi, a Rockwell "C" scale hardness of about 34, and an elongation to failure of about 10%.

EXAMPLE 2

A sintered and annealed bolt blank is prepared using the general procedure of Example 1. Before machining the sintered and annealed bolt blank to the final bolt geometry, the sintered and annealed bolt blank is cold worked, and a bolt with the required mechanical properties is obtained.

EXAMPLE 3

A sized tungsten based bolt blank of the composition of Example 1 is sintered and annealed as in Example 1. The blank is inserted at ambient temperature into a forming die. With actuation of the forming press cycles, the desired configuration is created in the part. Due to the mechanical working that occurs during press forming, the material exhibits a higher yield strength and increased hardness. The worked blank is then machined to the final desired bolt geometry.

EXAMPLE 4

If the general procedure of Example 3 is repeated using an elevated temperature in the forming die, similar results will be obtained.

EXAMPLE 5

A tungsten based rod of the composition of Example 1 is sintered and annealed as in Example 1. The rod is swaged to provide the desired strength and ductility and is then subsequently machined to the final geometry. The mechanical work introduced by the swaging imparts the required strength for the given action design and the hardness increase required for wear resistance in this application.

EXAMPLE 6

A sized tungsten based metal blank of the composition of Example 1 is sintered and annealed as in Example 1. The blank is inserted into an upsetting die. With actuation of the press cycle, the part is mechanically worked in compression, thereby providing increased yield strength and hardness. The bolt configuration is then machined from the blank.

EXAMPLE 7

A tungsten based rod of the composition of Example 1 is sintered and annealed as in Example 1. The rod is reduced in diameter by being forced through an extrusion die, mechanically working the material. This mechanical work imparted by the extrusion process imparts the required strength and hardness for the given design. The rod is then machined into the final configuration.

We claim:

1. A firearm bolt end comprising, elementally, in parts by weight, about from 70 to 98% tungsten, the balance comprising nickel and iron, wherein the ratio of nickel to iron is about from 1.5:1 to 5:1, the bolt further comprising up to about 20% by weight of at least one metal selected from the group consisting of molybdenum, cobalt, rhenium, tantalum and gold.

2. A firearm bolt of claim 1 comprising about 85% tungsten, 8% molybdenum, 5.1% nickel, 1.4% iron, and 0.5% cobalt.

3. A firearm bolt of claim 1 having at least a barrel end and further comprising a facing attached to the barrel end.

4. A firearm bolt of claim 3 wherein the facing is prepared from a material selected from the group consisting of steel, ceramic and thermoplastic.

5. A firearm bolt comprising tungsten, nickel, and iron in weight percentages to yield a density in a sintered form of about from 14.1 g/cc to 18.0 g/cc.

6. A firearm bolt of claim 5 further comprising at least one metal selected from the group consisting of molybdenum, cobalt, rhenium, tantalum and gold.

7. A firearm bolt of claim 5 further comprising a steel, ceramic or plastic face applied to the barrel end of the firearm bolt.

8. A process for manufacturing a firearm bolt comprising the steps of:

admixing about from 70 to 98% by weight tungsten, the balance comprising nickel and iron, wherein the ratio of nickel to iron is about from 1.5:1 to 5:1, to form a powder metal mixture;

pressing the powder metal mixture to form a green bolt blank compact;

sintering the green bolt blank compact to form a sintered bolt blank; and finishing the sintered bolt blank to form a finished firearm bolt.

9. A process of claim 8 wherein the admixing step further comprises admixing in the powder metal mixture up to about 20% by weight of at least one metal selected from the group consisting of molybdenum, cobalt, rhenium, tantalum and gold.

10. A process of claim 8 wherein the admixing step further comprises admixing in the powder metal mixture about from 0.5% to 2% of a low melting point wax.

11. A process of claim 10 wherein the admixing step further comprises admixing in the powder metal mixture about 1.0% of a low melting point wax.

12. A process of claim 8 wherein the finishing step further comprises machining the sintered bolt blank to form a finished firearm bolt.

13. A process of claim 8 wherein the finishing step further comprises:

annealing the sintered bolt blank to form an annealed bolt blank; and machining the annealed bolt blank to form a finished firearm bolt.

14. A process of claim 8 wherein the finishing step further comprises:

mechanically working the sintered bolt blank to form a worked bolt blank; and machining the worked bolt blank to form a finished firearm bolt.

15. A process of claim 8 wherein the finishing step further comprising:

annealing the sintered bolt blank to form an annealed bolt blank;

mechanically working the annealed bolt blank to form an annealed and worked bolt blank; and machining the annealed and worked bolt blank to form a finished firearm bolt.

16. A process of claim 8 wherein the finishing step further comprises:

mechanically working the sintered bolt blank to form a worked bolt blank;

annealing the worked bolt blank to form a worked and annealed bolt blank; and machining the worked and annealed bolt blank to form a finished firearm bolt.

* * * * *